United States Patent [19]

Fox

[11] 4,265,147

[45] May 5, 1981

[54] WORKING PIT WITH ARTICULATED TOOL ARM ASSEMBLY

[75] Inventor: Albert D. Fox, Novi, Mich.

[73] Assignee: D. W. Zimmerman Mfg., Inc., Madison Heights, Mich.

[21] Appl. No.: 91,477

[22] Filed: Nov. 5, 1979

[51] Int. Cl.[3] ..... B25B 17/00

[52] U.S. Cl. ..... 81/55; 81/57.41; 248/571; 248/654

[58] Field of Search ..... 81/54, 55, 56, 57.41, 81/57.24, 57.25, 57.35, 57.4; 248/654, 662, 571

[56] References Cited

U.S. PATENT DOCUMENTS

| | | | |
|---|---|---|---|
| 2,582,442 | 1/1952 | Lapp | 81/57.4 |
| 2,690,896 | 10/1954 | Bissell et al. | 248/654 |

FOREIGN PATENT DOCUMENTS

| | | | |
|---|---|---|---|
| 2640447 | 3/1978 | Fed. Rep. of Germany | 81/57.4 |

*Primary Examiner*—James L. Jones, Jr.
*Attorney, Agent, or Firm*—Allen D. Gutchess, Jr.

[57] ABSTRACT

A working pit with an articulated tool arm assembly is provided for an automobile assembly line. A tool carried by the arm assembly is used to perform assembly operations in an automobile moving either longitudinally or transversely along the line. The articulated arm is mounted on a trolley which is movable longitudinally of the working pit along tracks adjacent a side wall of the pit. The tool arm can pivot horizontally toward and away from the pit wall and can pivot vertically to enable a tool holder at the end of the arm to move from a position at or below floor level to a position in the path of an automobile body moving along the assembly line above the pit. The tool holder enables the tool to rotate through a path of 360° and to tilt. The articulated arm is especially designed for use with a nut runner to tighten nuts and bolts underneath the automobile body, but can also be used with other tools. A nut retaining wrench or work holder can be carried by the tool holder and mounted for movement toward and away from the nut runner.

18 Claims, 10 Drawing Figures

WORKING PIT WITH ARTICULATED TOOL ARM ASSEMBLY

This invention relates to a working pit and an articulated arm assembly for an automobile assembly line.

Particularly with some of the more recent smaller automobile bodies, it has been found to be necessary to perform some of the assembly operations from underneath the bodies. The present invention provides a working pit with an articulated arm assembly which facilitates these assembly steps. The tool arm is counterbalanced and mounted on a trolley which moves longitudinally of the pit along tracks adjacent a side wall thereof. In this manner, the tool carried by the tool arm can be used to perform operations as the automobile moves over the pit along the assembly line conveyor. The tool arm can pivot toward and away from the pit wall in various positions transversely of the pit and pivot vertically to enable a tool holder at the end of the arm to move from a position below the assembly line to a position in the path of an automobile moving along the line. The tool holder enables the tool carried thereby to pivot through a path of 360° and to tilt at angles of approximately 20° on any side of the vertical. The maximum angle of tilt can be adjustable to smaller angles as required for the tool arm to resist torque loads.

It is, therefore, a principal object of the invention to provide a working pit with an articulated arm assembly to facilitate assembly operations on automobiles or the like.

Many other objects and advantages of the invention will be apparent from the following detailed description of a preferred embodiment thereof, reference being made to the accompanying drawings, in which.

Figure 1:
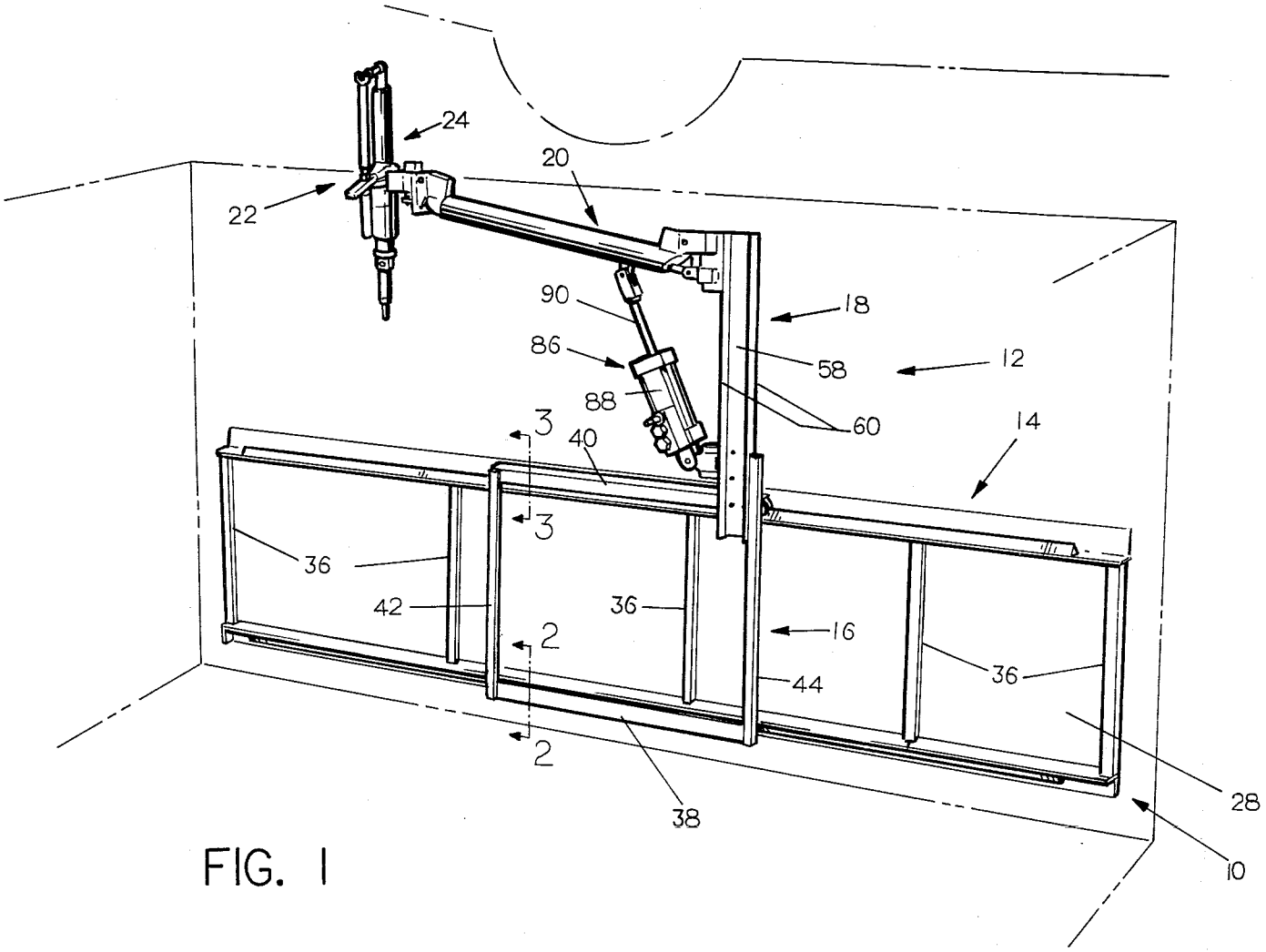
FIG. 1 is a somewhat schematic view in perspective of a working pit and an articulated tool arm assembly embodying the invention.

Referring to FIG. 1, a working pit 10 is located below an assembly line for automobiles, the pit extends longitudinally of the assembly line and can be narrower than the automobile bodies and even sufficiently narrow to be straddled by the wheels of the bodies moving along the assembly line conveyor. An articulated tool arm assembly 12 is mounted in the pit and facilitates assembly operations on an automobile body moving thereover. The assembly 12 includes a track assembly indicated at 14, a trolley 16, an upright support 18 mounted on the trolley 16, an articulated arm 20, and a tool holder 22. A tool 24 is mounted on the tool holder 22.

Figure 2:
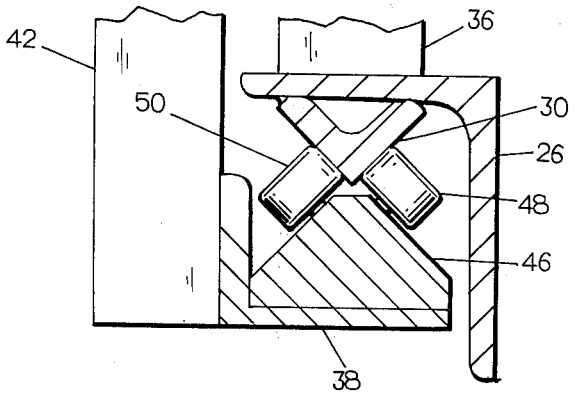
FIG. 2 is an enlarged, fragmentary view in transverse cross section, taken along the line 2—2 of FIG. 1.
Figure 3:
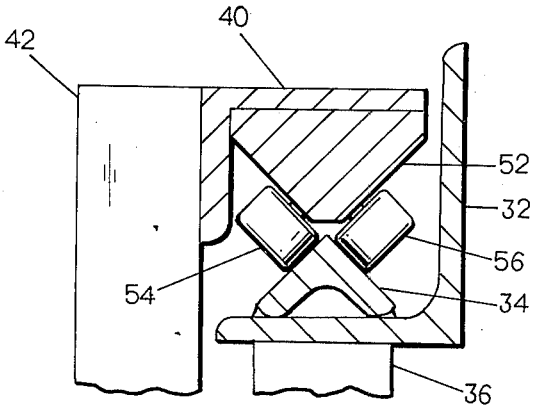
FIG. 3 is an enlarged, fragmentary view in transverse cross section taken along the line 3—3 of FIG. 1.

Referring to FIGS. 1 and 2, the track assembly 14 includes a mounting angle 26 which is affixed to a side wall 28 of the pit 10 and a smaller angle track 30 suitably affixed to the angle 26. Referring to FIGS. 1 and 3, an upper portion of the track assembly 14 includes a mounting angle 32 which is affixed to the pit wall 28 and a smaller angle track 34 suitably affixed thereto. The angles 26 and 32 are spaced apart by spacers 36 along the length of the track assembly.

The trolley 16 includes lower and upper horizontal frame members 38 and 40 connected by tubular end frame members 42 and 44, the latter extending upwardly above the former. Machined mounting blocks 46 are affixed at the ends of the lower frame member 38 and have spaced track wheels 48 and 50 rotatably mounted thereon and contacting the lower surfaces of the angle track 30. Similarly, machined mounting blocks 52 are affixed to ends of the upper frame member 40 and have spaced track wheels 52 and 54 rotatably mounted thereon in contact with the upper surface of the angle track 34. The mounting blocks 46 and 52 and the track wheels 48, 50, 54, and 56 can be mounted on the angle tracks 30 and 34 before the mounting blocks are affixed to the frame members 38 and 40, or the trolley can be installed from the ends of the tracks.

Figure 5:
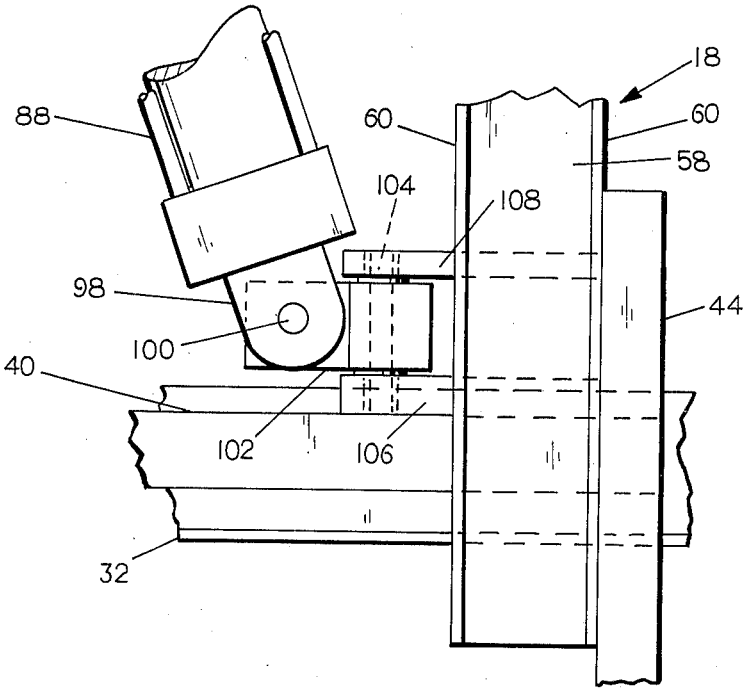
FIG. 5 is a fragmentary view in elevation of a counterbalancing ram and its pivotal connection with the upright support.

The upright support 18 is rigid, including a wide web 58 (FIGS. 1 and 5) and flanges 60. The support is rigidly affixed to an end of the upper frame member 40 of the trolley assembly 16 and is backed up by the upper end portion of the end frame member 44.

Figure 4:
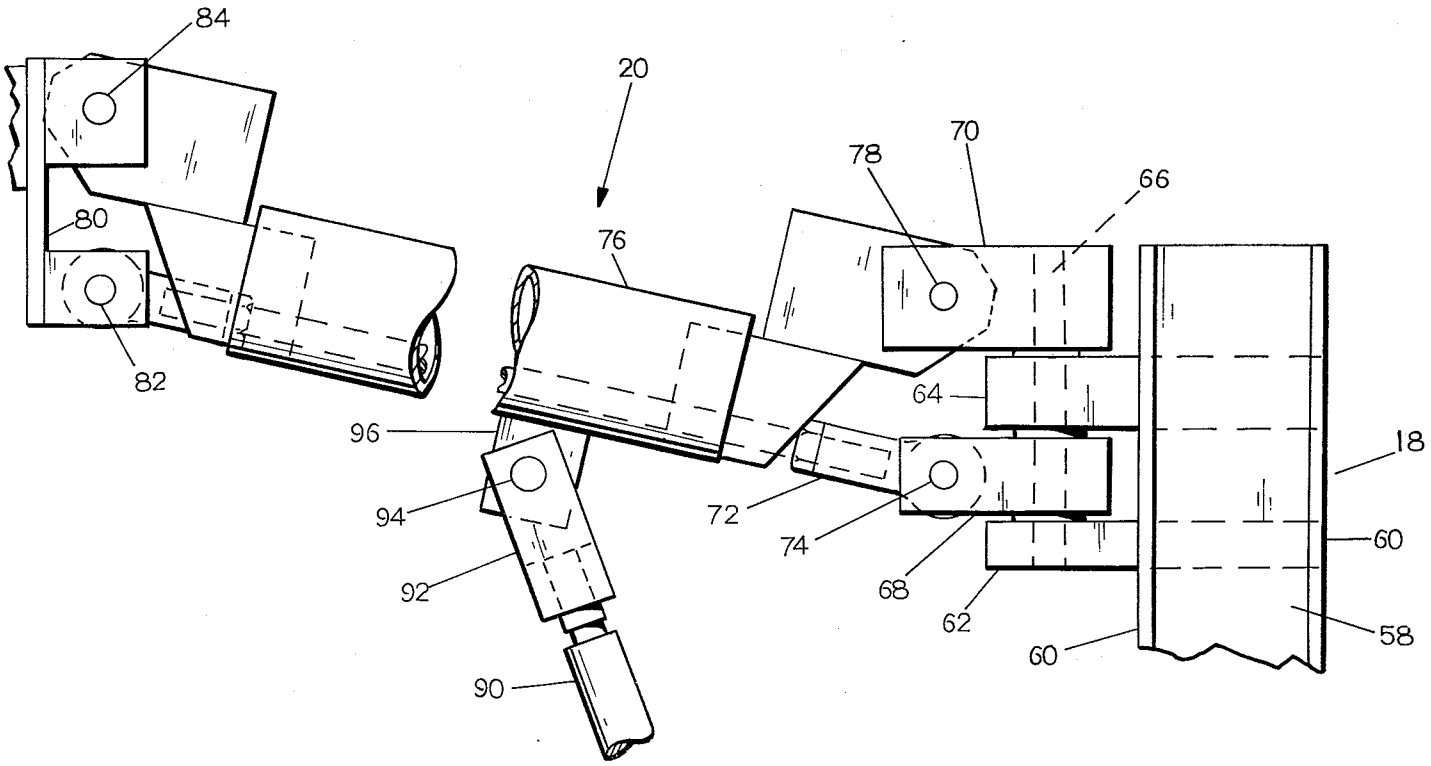
FIG. 4 is a fragmentary view in elevation of an articulated tool arm and its pivotal connection with an upright support.

The articulated arm 20 is pivotally supported at an upper end portion of the upright support 18 by two pivot brackets 62 and 64 (FIG. 4) suitably affixed thereto and extending therefrom. A pivot pin 66 is located in the brackets 62 and 64, along with suitable bushings, and extends through pivot ears 68 and 70. The ears are connected by a weldment (not shown) and pivot as a unit. The pivot ear 68 is pivotally connected to a parallel link or arm 72 by a pivot pin 74. The pivot ear 70 is similarly pivoted to a parallel link or arm 76 by a pivot pin 78. The second link 76 includes a tubular portion extending around the link 72. At the outer ends, the two links 72 and 76 are pivotally connected to a mounting member or plate 80 by pins 82 and 84, respectively, so that the mounting plate 80 always remains in a vertical orientation, parallel to the upright 18, regardless of its vertical position. The link 72 is adjustable lengthwise to control the angular orientation of the mounting plate 80. The tubular construction of the link 76 provides strength for the arm 20, provides greater protection from damage, and substantially eliminates the possibility of the operator or some other object being caught between the links 72 and 76.

The articulated arm assembly 20 includes a counterbalancing ram 86 having a fluid-operated cylinder 88 and a piston rod 90 extending therefrom. The piston rod 90 has an upper end clevis 92 (FIG. 4) pivotally connected by a pin 94 to an ear 96 affixed to the link 76 at a point spaced toward the mounting plate 80 from the pivot pin 78. The lower end of the cylinder 88 has a clevis 98 (FIG. 5) pivotally connected through a pin 100 to a pivot block 102. The block 102 is pivotally connected through a pivot pin 104 and bushings to pivot brackets 106 and 108 which are suitably affixed to a lower portion of the upright support 18. The pivot pins 66 and 104 are aligned on a vertical axis to enable the articulated arm 20 and the ram 86 to pivot about the support 18. Suitable stops can be mounted on the upright support 18, if desired, to limit the extent of pivotal horizontal movement of the articulated arm 20. Fluid pressure to the cylinder 88 can be adjusted to offset the weight of the articulated arm 20, the holder 22, and the tool 24 carried by the holder.

Figure 6:
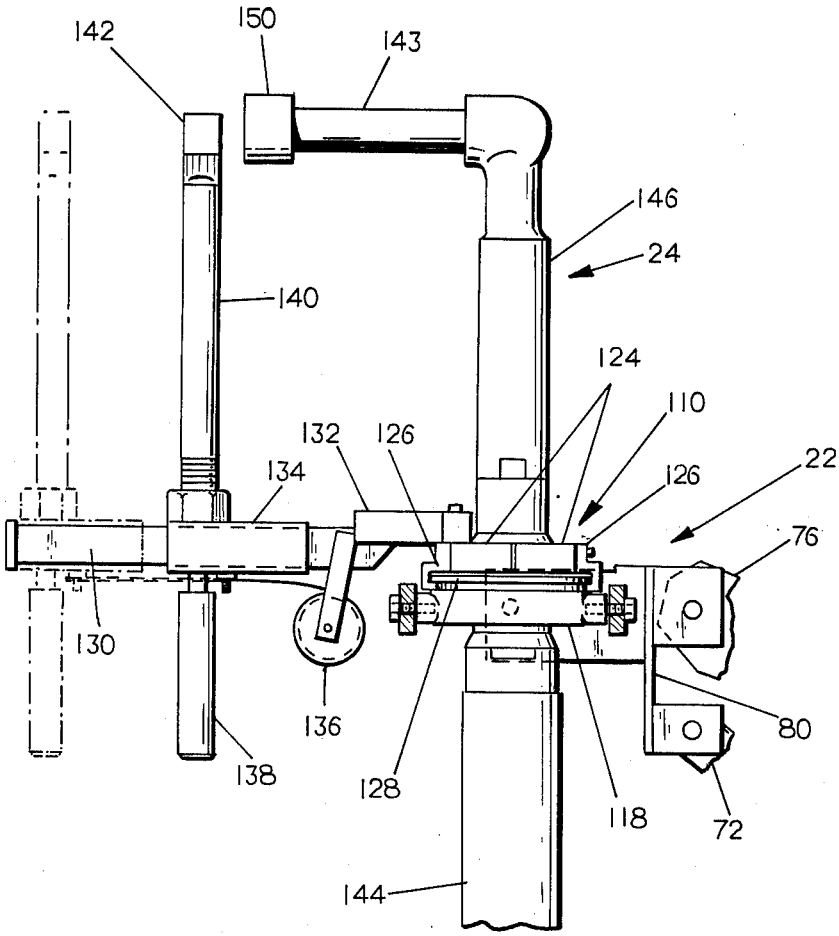
FIG. 6 is a fragmentary view in elevation, with parts broken away and with parts in section, of a tool holder and tool at the outer end of the tool arm.
Figure 7:
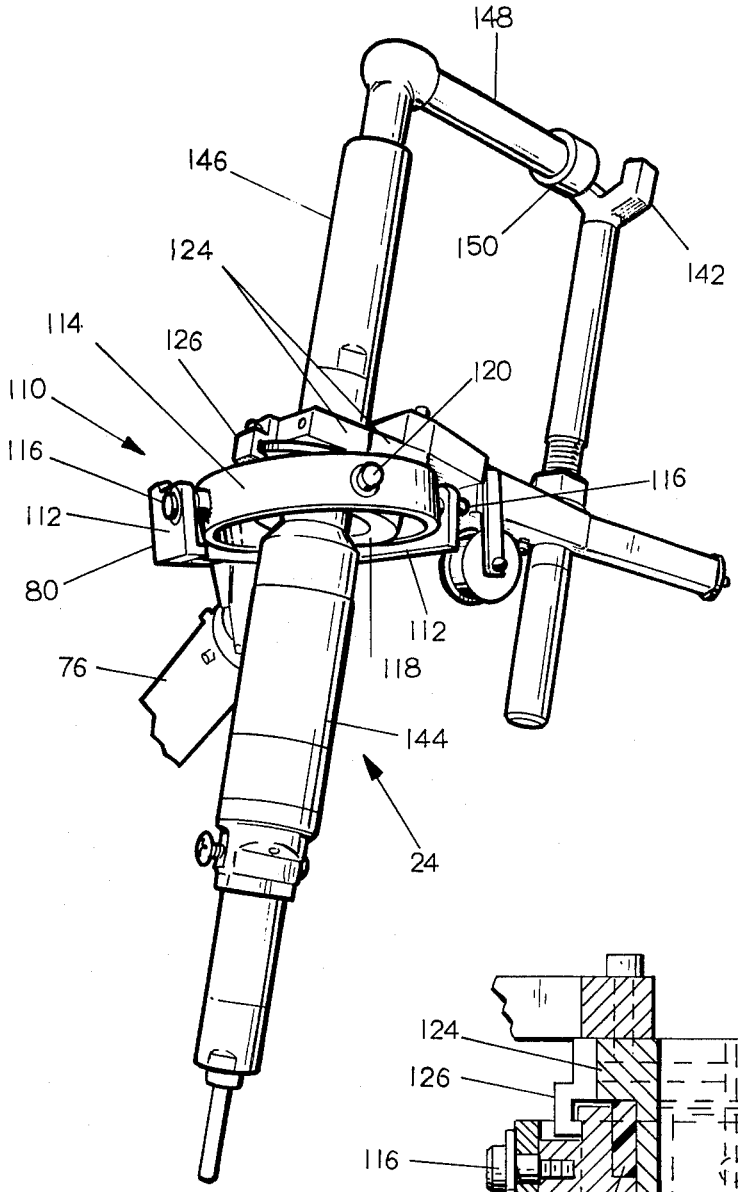
FIG. 7 is a view in perspective of the holder and tool of FIG. 6.
Figure 8:
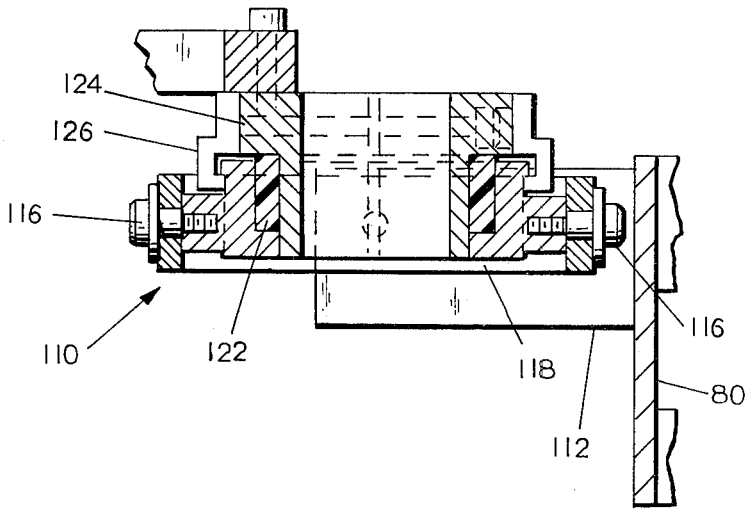
FIG. 8 is an enlarged, fragmentary view in vertical section taken through the tool holder of FIG. 6.

The tool holder 22 includes a gimbal 110 (FIGS. 6–8) mounted on the end plate 80. The gimbal includes side flanges 112 to which an outer ring 114 is pivotally attached by suitable pins 116. These pins can be on an axis which is at any angle relative to the mounting plate 80, being shown as parallel thereto. An inner ring 118 is pivotally connected to the outer ring 114 through pins 120 which are on an axis perpendicular to the pivot axis of the pins 116. The pins 116 and 120 have suitable bushings, as is well known in the art. The inner surface of the inner ring 118 constitutes the outer race for a plastic bearing cylinder 122. Clamping members 124 engage the tool 24 and have downwardly extending cylindrical portions constituting the inner race for the plastic bearing cylinder 122. In this manner, the clamping members 124 and the tool 24 can rotate 360° on an axis perpendicular to the axis of the pins 120. Retaining clips 126 on the clamping members 124 engage an annular flange 128 on the inner ring 118 to retain the tool 24 in position with respect to the inner ring 118 and the plastic bearing cylinder 122.

The outer ring 114 and the inner ring 118 can have adjustable stops secured to their pivot mounts to enable adjustment of the extent of the arcuate movement of each ring, thereby to resist and transmit any torque back to the arm 20.

Particularly when the tool 24 is a nut runner, the tool holder 22 can be equipped with a nut-holding device. Accordingly, a tubular extension 130 of square cross section can be affixed to the holder 22 by a bracket 132 and extend outwardly therefrom. An outer sleeve 134 is slidably mounted on the extension 130 and is urged toward the holder 22 by a constant force spring 136. A handle 138 extends downwardly from the tool holder and an adjustable supporting rod 140 extends upwardly from the sleeve 138 and can have a removable nut retaining wrench 142 mounted thereon. The tool 24 is commercially available and, as shown, has a lower air driven motor 144, an upper right angle drive 146, and a drive shank 148. A suitable wrench socket 150 is removably mounted on the shank 148.

With the above arrangement, the operator can push the handle 138 to space the retaining wrench 142 from the socket 150. The operator then manipulates the tool to align the socket 150 with a bolt to be tightened on the automobile body and then releases the handle 138 to engage the nut with the bolt and to hold the nut while turning the bolt with the tool 24. The articulated arm with the balancing arrangement enables the tool 24 to be readily moved anywhere in and above the working pit 10 with minimal fatigue to the operator.

Figure 10:
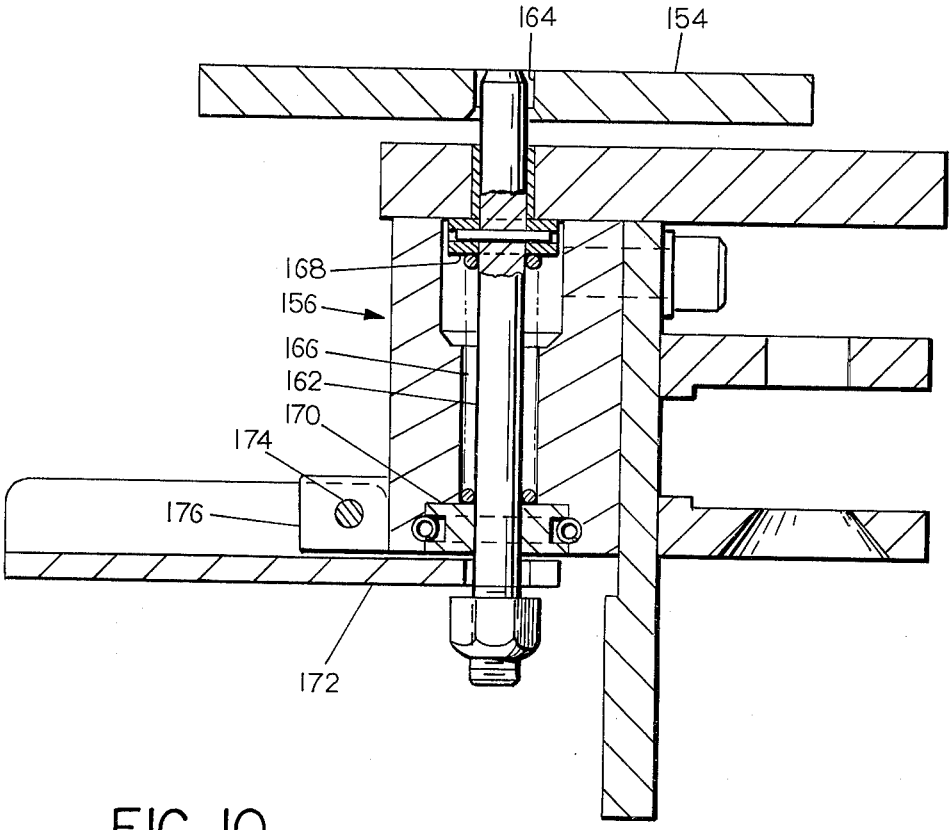
FIG. 10 is a view in cross section, taken along the line 10—10 of FIG. 9.
Figure 9:
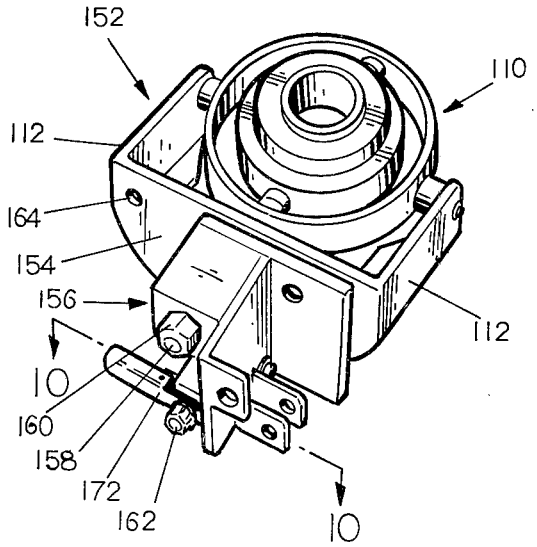
FIG. 9 is a view in perspective of a modified tool holder.

Referring to FIGS. 9 and 10, a modified tool holder 152 is shown. The holder includes the gimbal 110 and the side flanges 112 which are essentially the same as the corresponding components of the tool holder 22. The flanges 112 are affixed to and extend outwardly from a pivotable mounting plate 154, corresponding to the mounting plate 80 but being pivotable with respect to the links 72 and 76. This enables a tool held in the gimbal 110 to be placed in additional positions.

The pivotable mounting plate 154 is pivotably supported by a pivot member or block 156 through a pivot stud 158 which is affixed to the plate 154 and extends through the block 156 to a nut 160. The pivot block 156 has ears corresponding to those on the mounting plate 80 for mounting the pivot block on outer ends of the links 72 and 76. In this instance, the ears are arranged so that the pivotable mounting plate 154 is parallel to the links rather than perpendicular thereto, as in the case of the plate 80.

A releasable pin 162 is carried for longitudinal movement by the block 156. The pin 160 has an outer end which is extendible into any one of several openings 164 in the mounting plate 154 to hold the plate 154 and the gimbal 110 in any of several fixed positions when pivoted thereto on the stud 158. The mounting plate 154 has at least two of the openings 164 to place the gimbal 110 in a generally horizontal position, as shown in FIG. 9, or in a generally vertical position.

The releasable pin 162 is urged toward the plate 154 by a spring 166, which bears against a shoulder 168 on the pin 162 and is seated against a suitable ring 170 through which the pin extends. The pin 162 also extends through an end of a release lever 172, which is pivoted on a pin 174 held by ears 176 on the block 156. When the other end of the lever 172 is pushed, the pin 166 is pulled from the opening 164 in the plate 154 to enable the plate and the gimbal to be pivoted to another position. When in the new position, the pin 162 is moved into the new opening 164 by the spring 166 to hold the gimbal in that position.

Various modifications of the above-described embodiments of the invention will be apparent to those skilled in the art, and it is to be understood that such modifications can be made without departing from the scope of the invention, if they are within the spirit and the tenor of the accompanying claims.

I claim:

1. In combination, means forming a working pit along an automobile assembly line, supporting means extending longitudinally of said pit and affixed thereto, a trolley mounted on said supporting means for longitudinal movement toward the ends of the pit, an upright support mounted on said trolley and having a portion extending upwardly above said supporting means, arm means pivotally connected to said portion of said upright support, tool-holding means pivotally connected to an outer end of said arm means, and means carried by said upright support for counterbalancing the weight of said arm means and said tool-holding means.

2. The combination according to claim 1 characterized by a nut runner being held by said tool holder, a nut wrench, and means for moving said nut wrench toward and away from said nut runner.

3. the combination according to claim 1 characterized by said tool-holding means comprising a gimbal and bearing means carried by said gimbal for engaging a tool to enable the tool to rotate 360°.

4. An articulated tool arm assembly comprising a pair of tracks, means for holding said tracks in vertical, spaced relationship, a trolley mounted on said tracks for longitudinal movement, an upright support extending upwardly from said trolley above said tracks, a pair of connected parallel arms pivotally connected to an upper portion of said upright support, counterbalancing means connected to one of said arms and to said upright support to urge said arms upwardly, a mounting member pivotally connected to outer ends of said arms, and tool-holding means connected to said mounting member.

5. An articulated arm according to claim 4 characterized by said tool-holding means comprising a gimbal having an outer ring pivotally connected to said mounting member, an inner ring pivotally connected to said outer ring on an axis perpendicular to the pivotal axis of the outer ring, and bearing means within said inner ring for clamping a tool, whereby the tool can tilt in all directions and move in a 360° path.

6. An articulated arm according to claim 4 characterized by an extension mounted on said tool-holding means, work-holding means slidably mounted on said extension, and means for urging said work-holding means toward said tool-holding means.

7. An articulated arm according to claim 6 characterized by a nut runner being held by said tool-holding means and a nut wrench carried by said work-holding means.

8. In combination, means forming a working pit along an automobile assembly line over which move automobiles being assembled, spaced tracks mounted in parallel, vertical relationship along a side wall of pit, a trolley supported on said tracks for longitudinal movement thereon between end portions of said pit, an upright support mounted on said trolley and extending upwardly above said tracks but not extending above the top of said pit, two parallel arms pivotally connected to an upper portion of said upright support, mounting means located on the other ends of said arms and pivotally attached thereto whereby said mounting means will remain in a substantially constant orientation when said arms are pivoted vertically, said arms also being pivotally mounted on said upright support for horizontal pivotal movement, tool-holding means including a gimbal carried by said mounting means, said tool-holding means including means for engaging a tool and for enabling the tool to move through a 360° path, and fluid-operated means connected between one of said parallel arms and said upright support for urging said arms in an upward direction.

9. The combination according to claim 8 characterized by a nut runner being carried by said tool-holding means, an extension extending in a general horizontal position from said tool-holding means, a sleeve slidably carried on said extension for movement toward and away from said tool-holding means, and a work holding member extending upwardly from said sleeve.

10. The combination according to claim 9 characterized by spring means connected with said sleeve for urging said sleeve and said work-holding means toward said tool-holding means.

11. The combination according to claim 8 wherein said mounting means comprises a pivotable mounting plate carrying said tool-holding means and a pivot member located on said other ends of said arms and pivotably connected to said mounting plate.

12. The combination according to claim 11 characterized by said pivot member having a releasable pin and said mounting plate having at least two openings into which said pin can extend.

13. The combination according to claim 12 characterized by resilient means for urging said releasable pin toward said mounting plate.

14. The combination according to claim 12 characterized by a release lever pivotably carried by said pivot member and engagable with said releasable pin for moving said releasable pin away from said mounting plate.

15. The combination according to claim 13 characterized by a release lever pivotably carried by said pivot member and engagable with said releasable pin for moving said releasable pin away from said mounting plate.

16. An articulated arm assembly comprising a pair of tracks, means for holding said tracks in vertical, spaced relationship, a trolley mounted on said tracks for longitudinal movement therealong, an upright support extending upwardly from said trolley above said tracks, two connected parallel arms pivotally connected to an upper portion of said upright support, one of said arms having a tubular portion and the other of said arms extending through said tubular portion, counter balancing means connected to said tubular portion of said one arm and to said upright support to urge said arms upwardly, a mounting member pivotally connected to outer ends of said arms, and holding means connected to said mounting member for holding and manipulating an object.

17. An articulated assembly arm according to claim 16 characterized by said holding means comprising a gimbal having an outer ring pivotally connected to said mounting member, an inner ring pivotally connected to said outer ring on an axis perpendicular to the pivotal axis of the outer ring, and bearing means within said inner ring for clamping an object, whereby the object can tilt in all directions and move in a 360° path.

18. An articulated arm comprising a support, means for supporting said support to enable said support to move in selected paths, two connected parallel arms having ends pivotally connected to an end portion of said support, one of said arms having a tubular portion and the other of said arms extending through said tubular portion, counterbalancing means connected to said tubular portion of said one arm and to said support to urge said arms in a direction away from said support, a mounting member pivotally connected to the other ends of said arms whereby said mounting member will retain a predetermined angular position with respect to said support when said arms are pivoted relative to said support, and holding means connected to said mounting member for holding and manipulating an object.

* * * * *